United States Patent [19]

Hardison

[11] Patent Number: 4,614,480

[45] Date of Patent: Sep. 30, 1986

[54] LIQUID PUMPING SYSTEM

[76] Inventor: John C. Hardison, 2500 W. Skelley, Tulsa, Okla. 74107

[21] Appl. No.: 577,578

[22] Filed: Feb. 6, 1984

[51] Int. Cl.[4] ..... F04D 9/04; F04D 17/08

[52] U.S. Cl. ..... 417/199 A; 417/202; 137/247.21; 415/219 C

[58] Field of Search ..... 417/199 A, 200, 201, 417/202; 137/247.21, 247.15, 247.13; 415/219 B, 219 C, 203, 206

[56] References Cited

U.S. PATENT DOCUMENTS

| | | | |
|---|---|---|---|
| 201,161 | 3/1878 | Cudell | 137/247.21 |
| 427,752 | 5/1890 | Delehanty | 137/247.21 |
| 1,215,881 | 2/1917 | Siemen | 417/199 A |
| 1,220,403 | 3/1917 | Doble | 415/219 B |
| 1,363,732 | 12/1920 | Heidmann | 137/247.21 |
| 1,563,337 | 12/1925 | Caputo | 417/200 |
| 1,910,775 | 5/1933 | Saxe | 417/200 |
| 1,993,267 | 3/1935 | Ferguson | 417/199 A |
| 2,036,713 | 4/1936 | McBath | 417/199 A |
| 4,067,663 | 1/1978 | Brooks et al. | 417/199 A |
| 4,290,736 | 9/1981 | Bernasconi | 417/199 A |
| 4,389,159 | 6/1983 | Sarvanne | 415/219 C |

*Primary Examiner*—Cornelius J. Husar
*Assistant Examiner*—Peter M. Cuomo
*Attorney, Agent, or Firm*—Schmidt, Johnson, Hovey & Williams

[57] ABSTRACT

The pumping system employs horizontal shaft pumping units, each of which may be vacuum primed by a priming chamber which is mounted on the discharge outlet of the pump volute at a position above the volute itself. Preferably, each of the pump volutes has its discharge passage inclined within the vertical plane of the volute so that friction losses at points of connection to other piping of the system is minimized and space occupied by the system is likewise reduced. The inclination of each discharge passage is such that no portion of the internal pumping chamber of the volutes is higher than the point of intersection between the discharge passage and the chamber, whereby to avoid trapping air within the chambers. Specially configured and arranged ball check valve assemblies downstream from each pump unit are designed to provide a pool of liquid submerging the seat for the valve of each assembly when the system is in an idle or standby condition whereby to promote an effective, air-tight sealing action.

4 Claims, 6 Drawing Figures

LIQUID PUMPING SYSTEM

TECHNICAL FIELD

This invention relates to horizontal shaft pumping apparatus for liquids and has particular utility in connection with sewage pumping systems.

BACKGROUND

One problem with vertical shaft pump systems resides in the fact that the motors for such units are typically located above the pumping impellers thereof such that seals associated with the vertical drive shafts for such impellers are likewise disposed above the normal area of flow and contact with liquid being pumped. Consequently, such seals are subject to more rapid dehydration and failure than would otherwise be the case.

Moreover, presently known vertical shaft systems frequently subject the liquid being pumped to excessive power demands due to friction losses arising from the manner in which the liquid is directed through the various twists and turns of the system's plumbing. Still further, check valves associated with such systems have experienced leakage due to improper and ineffective sealing, and excessive space is frequently needed to adequately contain and house all of the components associated with a particular pumping installation.

SUMMARY OF THE PRESENT INVENTION

Accordingly, an important object of the present invention is to alleviate the foregoing problems, and others, inherent in present vertical shaft liquid pumping systems by providing a horizontal shaft pumping arrangement having special features which address and resolve the deficiencies of the prior vertical shaft units.

To that end, the present invention contemplates having a vacuum priming chamber associated with the discharge passage of the pump volute and above the highest point in the volute chamber so that, when fully primed or in operation, the seals associated with the horizontal drive shaft of the pump impeller are totally submerged by the liquid, thereby maintaining the seals in a moist and pliable condition. Furthermore, the present invention contemplates having the discharge passage of each pump volute inclined, rather than disposed at a true vertical or a true horizontal attitude, which helps reduce the friction forces experienced by the liquid as it is pumped through the system and which also significantly reduces the space required to house and contain the overall system at an installation. This inclined attitude of the volute discharge outlet is also important in avoiding the tendency for air to become trapped within the chamber of the volute at a high point thereof. Improved seating and sealing of a check valve associated with each pump unit is achieved by a special design which encourages the formation and collection of a pool of liquid on the valve seat each time the system is turned off, thereby helping the check valve associated with such assembly to seal properly against its seat and prevent the passage of air back down into the pumping units.

DETAILED DESCRIPTION

The present invention has been illustrated and will hereinafter be described in connection with a sewage pumping station. However, such is by way of example only, since it will be appreciated that the invention has significant utility in connection with a wide range of other liquid pumping function as well.

Figure 2:
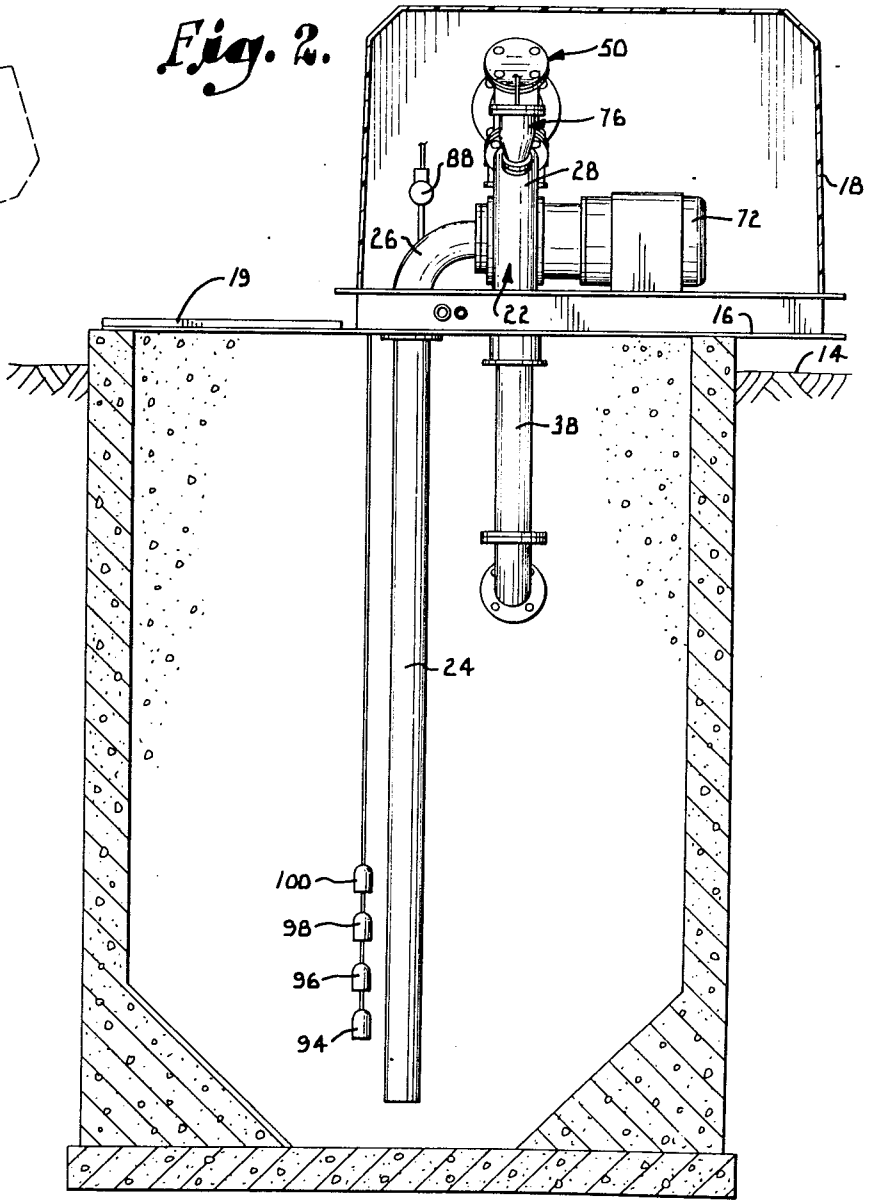
FIG. 2 is a similar view of the installation but taken from one side thereof.
Figure 1:
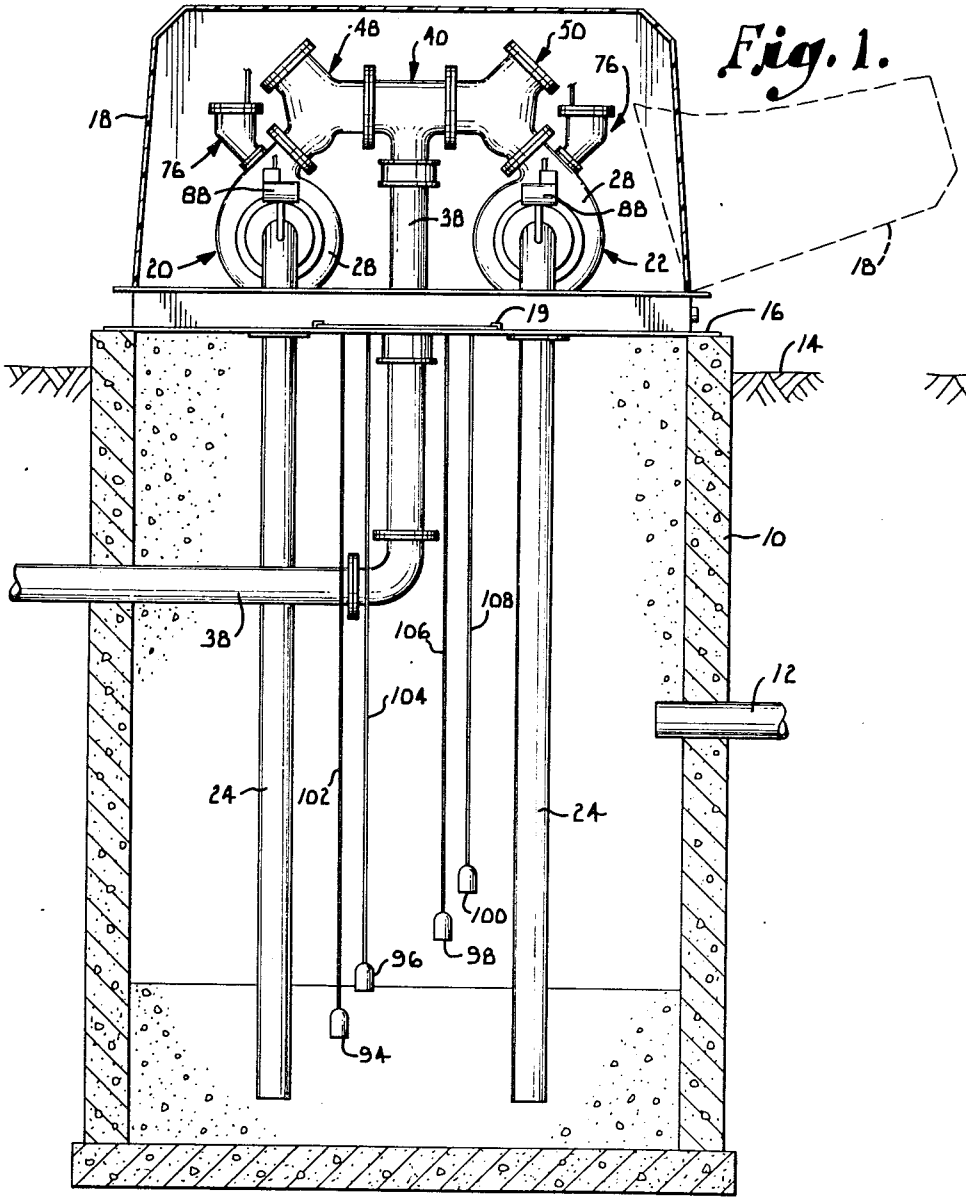
FIG. 1 is a partially elevational and partially cross-sectional view of a pumping installation employing a pump system embodying the principles of the present invention.
Figure 3:
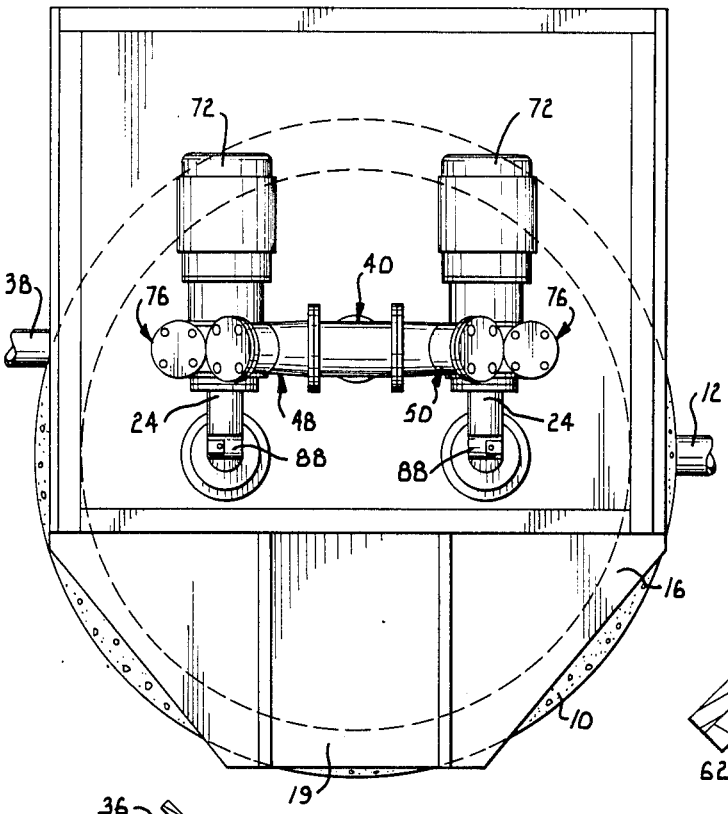
FIG. 3 is a top, plan view thereof with the cover removed to reveal details of the pumping mechanism.

The pumping installation as shown in FIGS. 1, 2, and 3 includes a well or pit 10 having a pipeline 12 which supplies the well 10 with sewage for collection therein. The upper end of the well 10 projects a short distance above the ground level 14 and supports a platform 16 which completely covers the open upper end of the well 10. Situated on one part of the platform 16 are aboveground components of a pumping system including a hinged cover 18 which may be swung between the solid line positions of FIGS. 1 and 2 protectively housing the components of the system and a phantom line position in FIG. 1 providing access to such components for maintenance and the like. A manhole lid 19 may be removed for access to the interior of well 10.

The pumping system may be broadly said to include a pair of separate, independently operable, horizontal shaft pump units 20 and 22, each of which has a vertically disposed inlet pipe 24 depending therefrom down into the well 10 to a point adjacent the bottom thereof. Each of the inlet pipes 24 passes upwardly through the platform 16 and has a right-angle elbow portion 26 which leads into the center of a pumping volute 28 having in internal chamber 30 housing an impeller 32 which is rotatable about a horizontal axis. The inlet passage 34 for the chamber 30 is disposed centrally thereof for communication with the elbow portion 26 of inlet pipe 24, and the outlet passage 36 of the volute 28 departs tangentially from the chamber 30 in the well-known manner.

Figure 6:
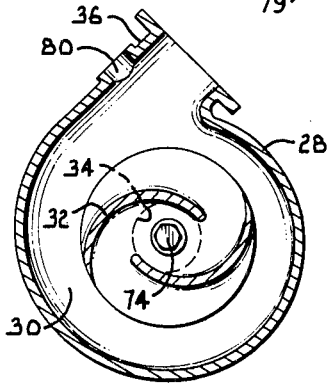
FIG. 6 is a cross-sectional view through one of the pump volutes illustrating internal details of construction.

As illustrated perhaps best in FIGS. 1 and 6, the volutes 28 of the pump units 20, 22 are disposed in generally upright planes, yet within such planes, their discharge passages 36 are disposed at an incline rather than being horizontally or vertically oriented. In this respect, the angle of such incline is preferably 45 degrees, but in any event it is important that no portion of the impeller chamber 30 be disposed higher than the highest point of intersection of the outlet passage 36 with the chamber 30, thereby eliminating and avoiding points within the volute 28 where air can become trapped either during operation or standby conditions. Thus, as shown in FIG. 1, the two volutes 28 are so oriented that their outlet passages 36 are inclined upwardly and inwardly toward one another for ultimate connection with a common discharge line 38 via a T-shaped tubular component 40 and other coupling structure yet to be described. In this respect, the tee component 40 includes a pair of oppositely projecting legs 42 and 44 for the pump units 20 and 22 respectively, as well as a third, centrally-disposed leg 46 disposed at right angles to the legs 42, 44 and having a flanged connection with the main discharge line 38.

Between the outlet passage 36 associated with pump unit 20 and the leg 42 of tee component 40 is disposed special coupling structure that includes a check valve assembly broadly denoted by the numeral 48. A similar check valve assembly 50 is disposed between the pump unit 22 and leg 44 of tee component 40, but since the assemblies 48 and 50 are identical, only the assembly 48 will be described in detail.

In this respect it will be noted that the assembly 48 comprises a generally tubular body that includes an inlet 52 at one end and an outlet 54 at the opposite end. Inlet 52 and outlet 54 are integrally interconnected and intersect one another at an oblique angle, preferably 135 degrees. The inlet 52 is flanged at its outer extremity for mating connection with and abutment against a similar flange on the outlet passage 36 of the volute 28. Similarly, the outlet 54 is flanged at its outer extremity for abutting engagement with the similarly flanged, proximal end of leg 42 of the tee component 40.

Figure 5:
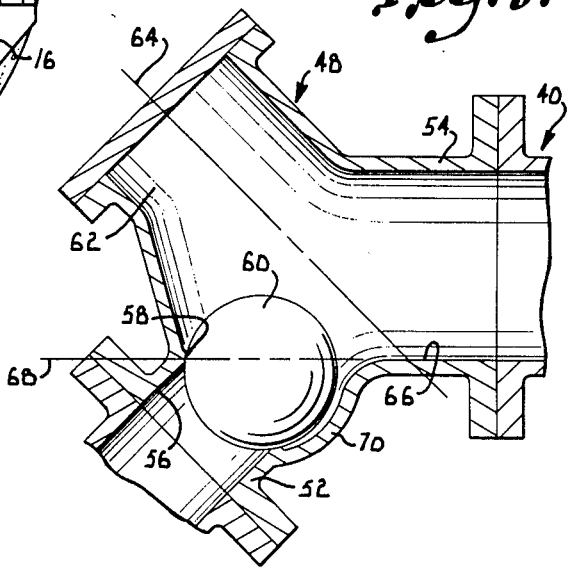
FIG. 5 is a fragmentary view of the system similar to FIG. 4 but focusing on the check valve assembly and illustrating the ball valve thereof in its closed position engaged against its seat.
Figure 4:
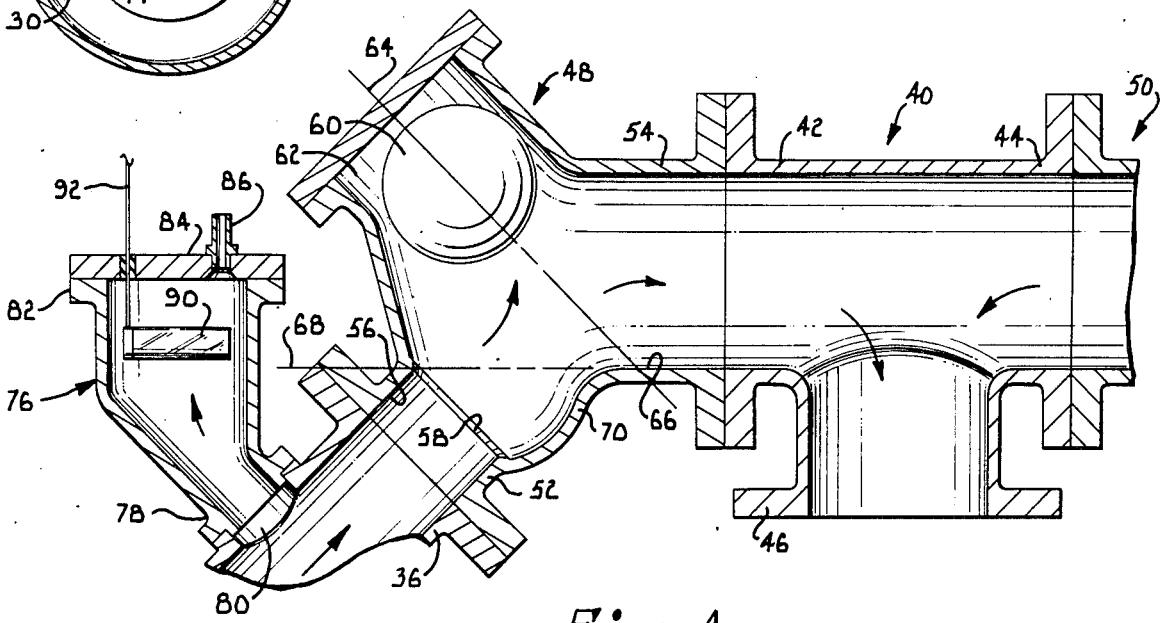
FIG. 4 is an enlarged, fragmentary sectional view of a portion of the pumping system illustrating the vacuum priming chamber and special ball check valve thereof, the ball valve being illustrated in its unseated or open position.

The interior wall surface 56 of the inlet 52 is beveled at the end of inlet 52 nearest the outlet 54 to provide and define a valve seat 58 for a valve member 60 which may take the form of a ball if desired. When the ball 60 is engaged against the seat 58 as illustrated in FIG. 5, the inlet 52 is completely closed, while when the ball 60 is off the seat 58 as illustrated for example in FIG. 4, the inlet 52 is open and unobstructed. A cavity 62 having a longitudinal axis 64 is disposed in laterally offset relationship to the inlet 52 and outlet 54 for the purpose of receiving the ball 60 as illustrated in FIG. 4 when the same is off the seat 58, whereby to provide an unobstructed path of flow from inlet 52 to the outlet 54. The ball 60 is guided in such movement by suitable internal guides in the form of ribs or grooves not illustrated herein but well understood by those skilled in the art. It will be noted that the longitudinal axis 64 of the cavity 62 bisects the angle between the inlet 52 and the outlet 54.

The check valve assembly 48 is so arranged that the outlet 54 is disposed in a substantially horizontal attitude, with the inlet 52 approaching the same from below. In this respect, seat 58 is substantially, if not entirely, disposed below the lowest part of the interior wall surface 66 of outlet 54. This relationship is illustrated in FIG. 4 by an imaginary line 68 which continues as an extension of the lower portion of interior wall surface 66 to the left thereof traversing the inlet 52, and it will be noted that the seat 58 is below such line 68. A basin 70 is integrally formed in the tubular body of the assembly 48 between the seat 58 and the wall surface 66 of outlet 54 in opposed relationship to the cavity 62, such basin 70 being likewise disposed below the line 68. For the sake of improved flow, the outlet 54 and those conduit portions downstream therefrom are larger in diameter than the outlet passage 36 of the volute 28.

The pump units 20 and 22 each further include a motor 72 having a horizontally disposed drive shaft 74 (FIG. 6) which extends into the back side of the corresponding volute 28 in co-axial alignment with the inlet passage 34 on the opposite side thereof and which is operably coupled to the impeller 32 for rotating the latter in a counterclockwise direction viewing FIG. 6.

Each of the pump units 20, 22 is also provided with a vacuum priming chamber 76 coupled with the outlet passage 36 downstream from the pumping chamber 30 and upstream from the check valve assembly 48. Each priming chamber 76 has a lower open end 78 which is sealably attached to the outlet passage 36 in communication with the interior thereof via an opening 80 in the sidewall of outlet passage 36. The chamber 76 projects upwardly from such opening 80 and terminates at its opposite upper end 82 in a closed cap 84 provided with a tubular fitting 86 that is in turn connected by appropriate tubing or piping (not shown) to a vacuum pump 88 (FIGS. 1 and 2) mounted for convenience upon the elbow 26 of inlet pipe 24. Although not shown herein, it will be understood by those skilled in the art that a suitable check valve arrangement is provided in connection with the fitting 86 or the tubing which connects the same with the vacuum pump 88 whereby to permit a vacuum to be drawn in the chamber 76 via the fitting 86 yet preclude the passage of liquid through the fitting 86 when the chamber 76 becomes filled as will subsequently be described.

A buoyant switch 90 is suspended within each priming chamber 76 by a conductor 92. It will be appreciated that the conductor 92 is sufficiently yieldably resilient as to permit the switch 90 to become tilted from the horizontal position illustrated in FIG. 4 upon the accumulation of liquid within the priming chamber 76 to such a level that it rises to the switch 90. When so tilted, the switch 90 is operable to close a circuit of which the conductor 92 is a part to thereby have an operating effect upon the system as described below.

A series of four switches 94, 96, 98, and 100 (FIGS. 1 and 2) are suspended within the well 10 by corresponding conductors 102, 104, 106, and 108 and are of similar construction to the switch 90 with its conductor 92 for the purpose of controlling operation of the system.

OPERATION

In use, it is contemplated that under normal circumstances only one of the pump units 20 and 22 will be in operation at any one time. The other will function in the capacity of a backup unit. Broadly speaking sewage is supplied to the well 10 by the pipeline 12 and accumulates therein to a certain predetermined level, whereupon the selected pump unit 20 or 22 is activated to lift the sewage out of the well 10 via the inlet line 24 through the pumping action of the rotating impeller 32 wihin volute 28. The lifted sewage is then delivered through check valve assembly 48 and tee component 40 to the main discharge line 38 for movement to a remote location. When a sufficient quantity of the sewage has been pumped from the well 10 to lower the contents down to a predetermined level as detected by the appropriate one of the switches 94, 96, 98, or 100, the operating unit 20 or 22 is turned off temporarily until the level of sewage accumulating in the well 10 once again rises to the appropriate height.

It is important to note that during the time the pumping unit 20 or 22 is in operation, the ball valve 60 associated with that pump unit will be in its non-flow-obstructing position of FIG. 4 so that the sewage may be readily pumped through the outlet passage 36 and into the tee component 40. On the other hand, the ball valve 60 associated with the non-activated pump unit will be disposed in the seated position of FIG. 5, thereby preventing sewage from simply being pumped up one inlet pipe 24 and down the other.

Furthermore, it will be noted that the transfer from inlet pipe 24 to the discharge line 38 is accomplished in a relatively non-turbulent, smooth manner such that frictional line losses are held to a minimum, thereby decreasing the power requirements of the system. The inclination of the outlet passage 36 is highly significant in this respect since an abrupt right-angle turn is prevented. Yet, because no portion of the pumping chamber 30 is disposed at a higher level than the intersection between the outlet passage 36 and the chamber 30, the trapping of air within chamber 30 is completely avoided. Because the highest point in the volute 28 is the outlet passage 36 itself, any air moving through the system finds its way to the passage 36 instead of being trapped within the chamber 30.

When the operated pump unit 20 or 22 is deactivated and placed in a standby mode, the ball valve 60 of the corresponding check valve assembly 48 settles down into its FIG. 5 position to sealingly engage the seat 58, thereby preventing any air existing within the discharge line 38 from traveling down through the outlet passage 36 and into the pump volute 28. In this respect it is to be appreciated that because the valve seat 58 is disposed at least substantially below the level of imaginary line 68 shown in FIGS. 4 and 5 which corresponds with the lower portion of the interior wall surface 66 of outlet 54, a pool of liquid will tend to accumulate around the ball 60 at its zone of engagement with the seat 58, aided in this respect by the basin 70, to thereby produce an even more effective, airtight seal of the outlet passage 36. Consequently, there is significantly reduced opportunity for air to escape around the ball valve 60 and travel down into the outlet passage 36 than with prior constructions.

Notwithstanding the presence of the effective seal provided by ball valve 60 against seat 58, there is a certain amount of leakage within the system below the check valve assembly 48 which cannot be entirely avoided. Consequently, each of the pumping units 20, 22 is provided with its own separate, independent vacuum priming chamber 76 and vacuum pump 88 which is operable to fully prime the pump unit in question before the motor 72 thereof is energized at the initiation of a pumping cycle. In this respect, when the appropriate detector switch in the series 94, 96, 98, and 100 determines that a new pumping cycle should be commenced, the appropriate vacuum pump 88 is first actuated to draw a vacuum within its chamber 76 and all portions of the system below the latter. Consequently, liquid is drawn up through the system until the corresponding pumping chamber 30 is completely filled and liquid has been drawn up into the vacuum priming chamber 76 to the level detected by mercury switch 90. Upon actuation of the mercury switch 90, the vacuum pump 88 is de-energized and the main pumping motor 72 is turned on to actually commence the large-scale pumping operation.

It will be noted that the mercury switch 90 is disposed at substantially the same level, or higher than, the valve seat 58 such that when priming the pump, liquid is drawn completely up to the check valve 60. Consequently, little or no air is trapped between the rising liquid and the lower side of the ball valve 60 prior to commencing actuation of the pumping impeller 32.

Moreover, it is to be appreciated that by having the vacuum priming chamber 76 located in connection with the outlet passage 36, which is the highest point on the volute, any and all seals associated with the drive shaft 74 for the impeller 32 will be submerged to a significantly greater extent than would otherwise be the case, causing them to be maintained in a moistened and soft condition for reliability and long life.

Still further, it will be noted that the inclined, converging nature of the two outlet passages 36 of the pump units 20, 22 lends a compact, overall configuration to the system which is highly desirable. That configuration also contributes significantly to lower frictional line losses as hereinabove explained.

It is to be understood that the foregoing is a disclosure of but the preferred embodiment of the present invention. Minor modifications and variations may be obvious to those skilled in the art without departing from the gist of the present invention.

I claim:

1. In a liquid pumping system:

a pair of horizontal shaft pump units each including a motor, a pumping impeller operably coupled with the motor for rotation about a horizontal axis, and a volute having an internal chamber receiving said impeller, each of said volutes having an inlet passage entering the chamber adjacent the center thereof and an outlet passage having an interior intersection with and departing from the chamber in a generally tangential manner, said volutes being so positioned about their respective said horizontal axes that said outlet passages are inclined upwardly and inwardly toward one another, each outlet passage being so inclined that no portion of the chamber is higher than the interior intersection between the outlet passage and the chamber;

a single discharge conduit common to both said units; and means coupling said outlet passages in flow communication with said discharge conduit, said outlet passages each having external, upwardly and inwardly facing, flat coupling surfaces at the downstream ends thereof disposed at right angles to the inclined axes of the outlet passages for connection with said coupling means.

2. In a pumping system as claimed in claim 1, wherein said coupling means includes a generally T-shaped, tubular component having a pair of oppositely extending legs adapted for receiving liquid from respective ones of said units and a third, central leg adapted for directing liquid from either of said oppositely extending legs to said discharge conduit.

3. In a pumping system as claimed in claim 2, wherein said coupling means further includes a transfer conduit for each unit having a pair of diverging tubular sections intersecting one another at an oblique angle, one tubular section of each conduit being connected to a corresponding leg of the T-shaped component and the other section of each conduit being connected to the outlet passage of the corresponding unit.

4. In a pumping system as claimed in claim 3, wherein each of said transfer conduits is provided with a check valve including a ball and a seat for the ball, each transfer conduit further having a laterally disposed clearance cavity for receiving the ball in a substantially non-flowobstructing position when the ball is off the seat.

* * * * *